United States Patent [19]

Martin

[11] Patent Number: 4,726,477

[45] Date of Patent: Feb. 23, 1988

[54] DISPLAY RACK

[75] Inventor: Larry Martin, Forest Grove, Oreg.

[73] Assignee: Old Trapper Smoked Products, Inc., Forest Grove, Oreg.

[21] Appl. No.: 939,910

[22] Filed: Dec. 9, 1986

[51] Int. Cl.[4] ..... A47F 3/14

[52] U.S. Cl. ..... 211/128; 211/181

[58] Field of Search ..... 211/128, 76, 74, 75, 211/134, 153, 84, 83, 88, 181, 194; 312/311, 319, 270

[56] References Cited

U.S. PATENT DOCUMENTS

| | | | |
|---|---|---|---|
| 895,867 | 8/1908 | Kirk | 211/84 |
| 1,044,471 | 11/1912 | Andrews | 211/84 |
| 1,214,502 | 2/1917 | Becker | 211/84 |
| 2,850,170 | 9/1958 | Palmer | 211/84 |
| 3,289,615 | 12/1966 | Marschak | 211/134 X |

*Primary Examiner*—Ramon S. Britts
*Assistant Examiner*—Sarah A. Lechok Eley
*Attorney, Agent, or Firm*—Chernoff, Vilhauer, McClung & Stenzel

[57] ABSTRACT

A display unit of welded wire or similar construction for display of food products packaged either in individual packages or displayed in jars open for removal of individual pieces. A pivoted cover is provided for a container in place on each of the shelves, with a horizontal cover flap pivot axis being vertically adjustable in position. The pivoted cover is permitted to swing only through a limited arc which results in the cover always being free to fall down atop an open jar or similar container and to interfere with placement of a jar on the shelf except beneath the cover flap.

17 Claims, 4 Drawing Figures

FIG. 2
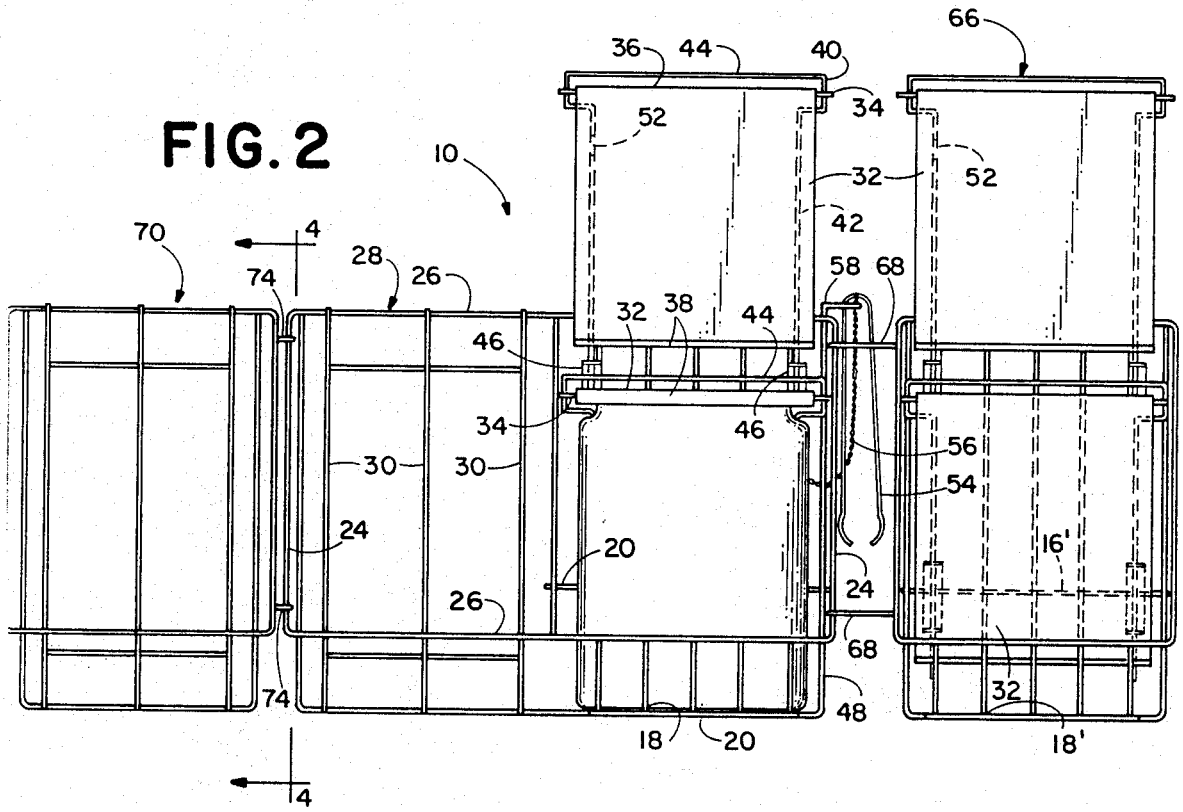
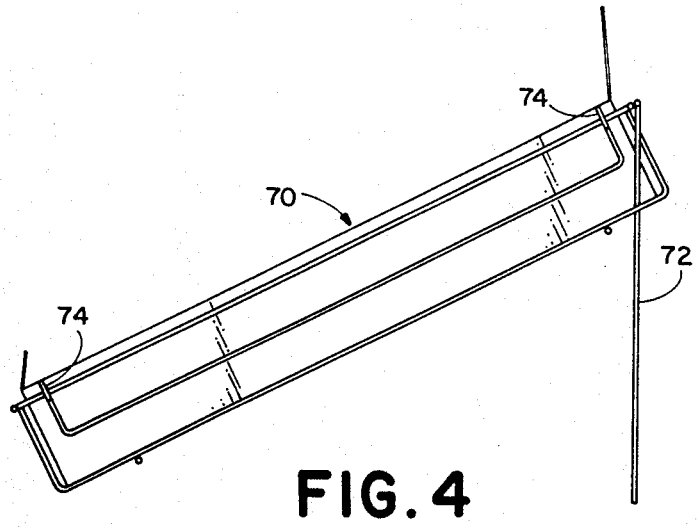
FIG. 4

DISPLAY RACK

BACKGROUND OF THE INVENTION

The present invention relates to display racks, and particularly to a display rack for edible products which require no refrigeration, but which need to be protected against contamination by airborne dust and the like.

Display racks should offer products attractively, yet accessibly, but in the case of food products display racks also need to protect against contamination of the food product. Where a food product is somewhat durable individual wrapping such as vacuum-sealed plastic coverings may be appropriate for individual pieces of food. Packaging of this sort, however, is somewhat bulky, making such packaging of individual pieces and transportation of goods packaged in that manner relatively expensive.

For display and sales of some food products such as stick candy, hard sausages, or sticks of jerky or other dried or smoked meat, exposure to the air is not likely to cause deterioration of the product. Pieces of such products, which are of relatively uniform size and which may be sold individually for immediate consumption, may be packed relatively densely within a container such as a screw-top jar which can be stored, shipped, and kept sealed until placed on display thereafter. Such products are usually sold quickly, with little chance of spoilage once such a jar has been opened. Nevertheless, the product should be kept covered to protect it from insects and airborne dirt. Replacing a screw-on lid, however, is somewhat time consuming and inconvenient, tempting a sales person not to replace the lid promptly. While loose-fitting lids are well known for display containers, such as jars of socalled "penny candy" such lids can easily be misplaced. Left temporarily upside down, such loose-fitting lids can collect dirt, which then can fall into the container when the lid is replaced, so that such a lid contributes to, rather than preventing, contamination of the products within the container.

Depending upon the location and amount of space available, a display rack should, ideally, be able to accommodate larger or smaller amounts of products.

In any case, a display rack should present a neat appearance and be sturdy enough to support the products for which it is intended.

What is needed, then, is a display rack for displaying goods at a point of sale, including goods such as food products in a container holding several unwrapped pieces and allowing removal of individual pieces from the container, while giving protection to remaining pieces within the container and ensuring that the container remains protectively covered except during the time when pieces of the food product are actually being removed.

SUMMARY OF THE INVENTION

The present invention overcomes the shortcomings of previously available display racks by providing a sturdy, light, yet uncomplicated display rack including a frame of wire construction. The display rack of the invention provides a sloping display portion for a container of individually wrapped items, as well as shelves for supporting upwardly open jars containing several individually consumable pieces of product. The display rack further includes an adjustably supported, pivotably mounted cover flap which ordinarily covers the open top of a displayed jar, yet permits access to the individual pieces contained within such a displayed jar with a minimum of effort. In a preferred embodiment of the invention a prop prevents the pivotable cover flap from falling downward to a vertical position, thus leaving the shelf unavailable for a display jar to be placed on the shelf, except beneath the cover flap. Another stop also prevents the cover flap from being lifted upward to a position from which it will not immediately fall downward to cover the open display jar, in a preferred embodiment of the invention.

In a preferred embodiment of the invention separate auxiliary shelves and baskets are provided by which to enlarge the capacity of the basic display unit.

It is therefore a principal object of the present invention to provide an improved display rack for attractively displaying products contained in a display container such as an upwardly open jar.

It is another important object of the present invention to provide a display rack for displaying several pieces of food in a single container, providing ready access to individual pieces, yet providing protective covering of the container.

It is a primary feature of the present invention that it provides a display rack equipped with a pivotably attached lid whose height is adjustable to accommodate precisely the height of a container.

It is another important feature of the present invention that it includes stops which require the placement of a container on a shelf of the display unit in such a position that the cover flap will automatically protect the contents of the container, except when someone is actually removing the contents from the container.

It is an important advantage of the present invention that it better provides for cleanliness of products displayed than has been provided by previously available display racks.

The foregoing and other objectives, features, and advantages of the invention will be more readily understood upon consideration of the following detailed description of the invention, taken in conjunction with the accompanying drawings.

BRIEF DESCRIPTION OF THE DRAWINGS

FIG. 2 is a front elevational view of the basic display rack shown in FIG. 1, together with an auxiliary section located at each side thereof.

FIG. 4 is a side elevational view of the left side auxiliary portion of the display rack shown in FIG. 2, taken along line 4—4.

DETAILED DESCRIPTION OF THE INVENTION

Figure 1:
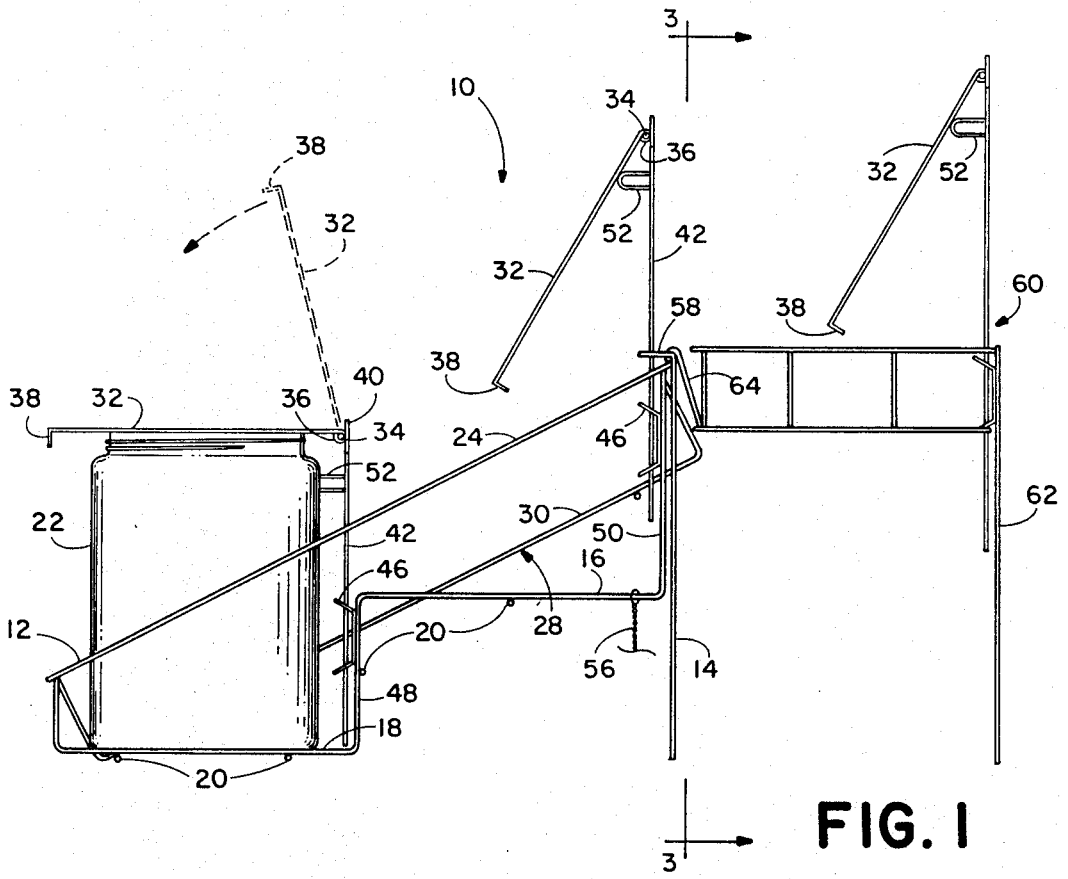
FIG. 1 is a side elevational view of a basic display rack embodying the present invention, together with an auxiliary upper rear shelf section.

Referring now to the drawings, in FIG. 1 a basic display rack 10 has a main frame 12 of welded wire construction, defining a front, a rear, and side portions and including a rear leg 14 located at each rear corner. The rack 10 includes a pair of shelves, an upper shelf 16, and a lower shelf 18, each defined by parallel wires running front-to-rear and interconnected by wire cross members 20. The shelves 16 and 18 are approximately square, and each provides an appropriate place for a container such as the jar 22 shown on the lower shelf 18. A pair of diagonal side rail members 24 and a pair of horizontal edge members 26, located at the upper rear and front of the main frame 12, outline the basic display rack 10. Alongside the upper and lower shelves 16 and 18 is a diagonally sloping, forwardly-and upwardly-open basket portion 28 whose bottom is defined by parallel sloping wires 30 extending from the upper rear to lower front portion of the rack 10. The basket portion 28 provides a location for an attractive display of goods such as individually wrapped hard sausages, which are commonly packaged for shipment in cardboard boxes as shown in FIG. 4, for sale of individual ones of the individually wrapped sausages and similar goods.

Snack foods, for example sticks of jerky, smoked jerky, or hard sausages, are frequently packaged for shipment and display in jars such as the jar 22, from which the pieces of food are made available individually for sale and immediate consumption. The display rack 10 of the present invention provides a selfclosing cover for such a jar 22, including a cover flap 32, preferably of sheet metal, which is mounted pivotably on a horizontal pivot rod 34. The rear edge portion 36 of the cover flap member 32 may, for example, be bent around the pivot rod 34, so that the cover flap member 32 can rotate freely about the pivot rod 34. This permits the front edge portion 38 of the cover flap member 32 to be raised to the position shown in broken line in FIG. 1, giving access to the interior of the jar 22.

To enable the cover flap 32 to fit tightly across the top of the jar 22, the horizontal pivot rod 34 is supported by a cover support member 40, a piece of wire having generally the shape of an inverted "U", and defining a pair of vertical wire portions 42 interconnected by a horizontal portion 44. Each of the vertical wire portions 42 is held adjustably in a spring-type clip 46 fixedly attached to a vertical portion 48 or 50 of the main frame 12. The spring clips 46 include a pair of end tabs each having a bore therethrough, with the respective vertical wire 42 extending through both of the end tabs. The end tabs are elastically biased apart from each other so that the bores grip the vertical wire legs 42 of the cover support member 40 to hold them stationary at a selected height, unless the tabs of the spring clip 46 are squeezed together, permitting adjustment of the height of the cover support 40. By adjusting the height of the cover support 40, the cover flap 32 may be positioned so that it fits closely and evenly over the open top of the jar 22.

The horizontal portion 44 of the cover support 40 acts as a preventer and prevents the cover flap 32 from being raised and tipped over beyond vertical, stopping the cover flap 32 in the position shown in broken line in FIG. 1, from which gravity returns the cover flap to its position atop the jar 22. Thus the cover flap 32 will be returned by gravity to its desired position covering the jar 22 after a piece of the product being displayed has been removed for sale or consumption.

A prop 52, which may be a small U-shaped piece of wire, is attached to one of the vertical wires 42, extending forward in position to prevent the cover flap 32 from falling to a downwardly extending vertical position. The prop 52 prevents the cover flap 32 from swinging below a diagonally downwardly extending position which prevents placement of a jar such as the jar 22 on the respective one of the shelves, except in a position beneath the cover flap 32. This ensures that any jar which is placed on the shelf with its lid removed will have the cover flap 32 above the open mouth of the jar, so as to protect the contents of such a jar against contamination.

In order to protect the contents of the jar 22 further from contamination, a pair of tongs 54 is attached to the main frame 12 by a chain 56, and a ring 58, shown best in FIG. 2, is provided to support the tongs 54 when not in use.

Figure 3:
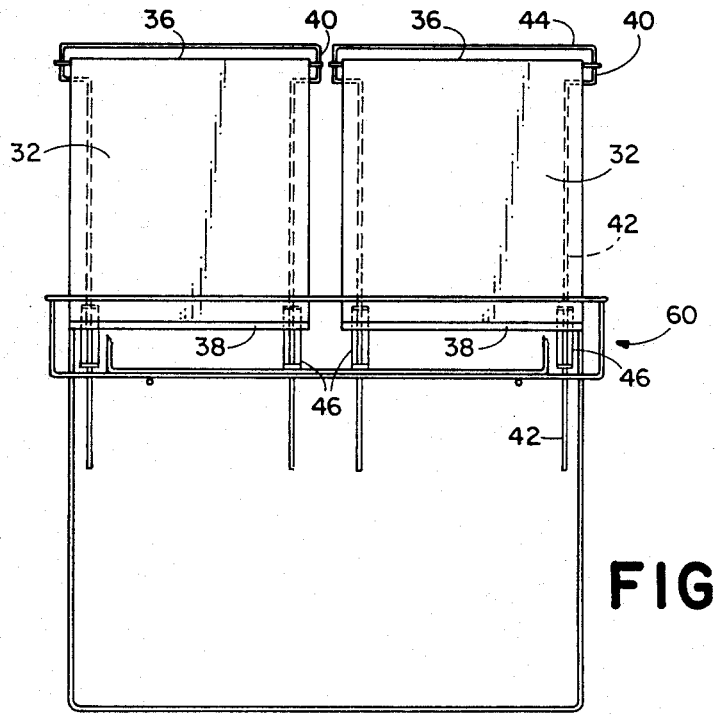
FIG. 3 is a front elevational view of the auxiliary rear shelf section shown in FIG. 1, taken along line 3—3.

Additional containers of products, of similar but slightly different types, for example, may be displayed on an auxiliary rear shelf portion 60 which is also of welded wire construction, including a vertical leg 62 at each of the left and right rear corners, and a pair of hooks 64 which fit around, and are supported by, the upper horizontal member 26 of the main frame 12 of the basic display rack 10 to support the front edge of the auxiliary shelf unit 60. The auxiliary rear shelf unit 60 includes a pair of cover flaps 32 supported independently by separate cover supports 40, as may be seen in FIG. 3, making each cover flap 32 adjustable in height to protect the contents of a container of products against contamination in the same manner described in greater detail in connection with the basic display unit 10.

As shown in FIG. 2, an auxiliary side shelf unit 66 is similar in construction to the portion of the basic display rack 10, including an upper shelf 16', a lower shelf 18' and respective cover flaps 32 and cover supports 40. A pair of laterally extending hook members 68 are provided to engage the diagonally extending side rail member 24 of the main frame 12 to attach the auxiliary side shelf unit 66 to the basic display rack 10, yet maintain a space, between the basic display rack 10 and the auxiliary shelf unit 66, adequate for access to the tongs 54.

To provide additional sloping display space for an upwardly open box of individually packaged products which do not require the protective presence of a cover flap 32 an auxiliary side basket unit 70 is provided as shown in FIGS. 2 and 4. It includes a pair of vertical rear legs 72 of wire to support the auxiliary side basket 70 in the proper sloping attitude parallel to the basket portion 28, as well as a pair of wire hook members 74 which engage the diagonal side rail member 24 of the basket portion 28 to attach the auxiliary side basket unit 70 to the basket portion 28 of the basic display rack 10.

By provision of shelves and a basket the display unit 10 provides for attractive display of individually consumable food items such as hard sausage sticks, jerky, and the like, either available for immediate consumption or individually protectively packaged. The auxiliary shelf units 60 and 66 and auxiliary basket unit 70 provide for display of additional quantities of such products and result in the display unit of the present invention being adaptable to different shelf spaces which may be available adjacent the cash register of a small store or restaurant, so that the size of the display may be varied as desired, depending on the volume of sales and number of varieties of products desired to be displayed.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A display rack for retail sales of goods such as small food items, comprising:

(a) a main frame defining a front, a rear, and a pair of sides;

(b) a shelf supported by said main frame;

(c) a cover support member located rearwardly adjacent said shelf and defining a horizontal axis of rotation;

(d) cover flap means, attached to said cover support member and rotatable about said horizontal axis of rotation defined by said cover support member, for ordinarily covering an upwardly open food container supported on said shelf, yet selectively providing access to the interior thereof; and (e) cover prop means attached to said cover support member for supporting said cover flap means in a position obstructing placement of a container on said shelf except beneath said cover flap means, said cover flap means being free to rotate downward about said horizontal axis into contact with said prop means except when a container is present on said shelf said cover support member being vertically adjustable with respect to said main frame.

2. The display rack of claim 1 wherein said frame and said shelf are of wire construction.

3. The display rack of claim 1, including a plurality of shelves located at different heights.

4. The display rack of claim 3 including one of said cover flap means and a respective cover support member associated with each of said shelves.

5. The display rack of claim 1 wherein said cover support member includes preventer means for preventing said cover flap means from being rotated upwardly away from a container resting on said shelf to a stable position.

6. The display rack of claim 5, wherein said preventer means includes a horizontally extending member spaced upwardly apart from said horizontal axis.

7. A display rack for retail sales of goods such as small food items, comprising:

(a) a main frame defining a front, a rear, and a pair of sides;

(b) a shelf supported by said main frame;

(c) a vertically adjustable cover support member located rearwardly adjacent said shelf;

(d) cover flap means, attached to said cover support member and rotatable about a horizontal axis defined by said cover support member, for ordinarily covering an upwardly open food container supported on said shelf, yet selectively providing access to the interior thereof;

(e) cover prop means associated with said cover support member for supporting said cover flap means in a forwardly and downwardly sloping attitude when said shelf is free of a container supported thereon, so as to prevent placement of a container on said shelf except beneath said cover flap means; and (f) an auxiliary shelf unit including at least one raised shelf having a respective cover support member and cover flap means associated therewith, said auxiliary shelf unit being attached to one side of said main frame by a pair of hook members extending laterally from said auxiliary shelf unit and engaging said main frame.

8. The display rack of claim 7 including a laterally extending tong support ring fixedly attached to said main frame at the rear thereof, said hook members of said auxiliary shelf unit being long enough to engage said main frame and leave space for said tong support ring between said main frame and said auxiliary shelf unit.

9. A display rack for retail sales of goods such as small food items, comprising:

(a) a main frame defining a front, a rear, and a pair of sides;

(b) a shelf supported by said main frame;

(c) a vertically adjustable cover support member located rearwardly adjacent said shelf, said cover support member including a vertical wire held at an adjustable height in a selectively releaseable holder fixedly mounted on said main frame;

(d) cover flap means, attached to said cover support member and rotatable about a horizontal axis defined by said cover support member, for ordinarily covering an upwardly open food container supported on said shelf, yet selectively providing access to the interior thereof; and (e) cover prop means associated with said cover support member for supporting said cover flap means in a forwardly and downwardly sloping attitude when said shelf is free of a container supported thereon, so as to prevent placement of a container on said shelf except beneath said cover flap means.

10. A display rack for retail sales of goods such as small food items, comprising:

(a) a main frame defining a front, a rear, and a pair of sides;

(b) a shelf supported by said frame;

(c) a vertically adjustable cover support member located rearwardly adjacent said shelf;

(d) cover flap means, attached to said cover support member and rotatable about a horizontal axis defined by said cover support member, for ordinarily covering an upwardly open food container supported on said shelf, yet selectively providing access to the interior thereof;

(e) cover prop means associated with said cover support member for supporting said cover flap means in a forwardly and downwardly sloping attitude when said shelf is free of a container supported thereon, so as to prevent placement of a container on said shelf except beneath said cover flap means; and (f) a rear auxiliary shelf unit having front and rear portions, including attachment means for attaching said front portion supportingly to said rear of said main frame, and including a rear leg supportingly attached to said rear portion of said rear auxiliary shelf unit.

11. A retail sales goods display rack for small items, comprising:

(a) a main frame of wire defining a front, a rear, and a pair of downwardly and forwardly inclined sides;

(b) a front shelf located at a lower level;

(c) at least one additional shelf located at a higher level and rearward from said front shelf;

(d) a sloping box display and support portion of wire construction, located laterally adjacent said front and rear shelves;

(e) a vertically adjustable cover support member located rearwardly adjacent one of said shelves;

(f) cover flap means including a front portion, attached to said cover support member and rotatable about a horizontal axis defined by said cover support member, between a horizontal position and an open position in which said front portion is raised above said horizontal position, for selectively covering and providing access to the interior of an upwardly open container supported on said one of said shelves;

(g) cover prop means associated with said cover support member for supporting said cover flap means with said front portion in a forwardly and downwardly sloping attitude when said one of said shelves is free of a container supported thereon; and (h) an auxiliary box display and support unit located laterally adjacent said sloping box display in support area of said main frame and attached thereto by a pair of hooks extending laterally from said auxiliary box display and support unit, said auxiliary box display and support unit having a vertically extending rear leg supporting a rear portion thereof.

12. A retail sales goods display rack for small items, comprising:

(a) a main frame of wire defining a front, a rear, and a pair of downwardly and forwardly inclined sides;

(b) a front shelf located at a lower level;

(c) at least one additional shelf located at a higher level and rearward from said front shelf;

(d) a sloping box display and support portion of wire construction, located laterally adjacent said front and rear shelves;

(e) a vertically adjustable cover support member located rearwardly adjacent one of said shelves, said cover support member including a vertical wire held at an adjustable height in a selectively releaseable holder fixedly mounted on said main frame;

(f) cover flap means including a front portion, attached to said cover support member and rotatable about a horizontal axis defined by said cover support member, between a horizontal position and an open position in which said front portion is raised above a said horizontal position, for selectively covering and providing access to the interior of an upwardly open container supported on said one of said shelves; and (g) cover prop means associated with said support member for supporting said cover flap means with said front portion in a forwardly and downwardly sloping attitude when said one of said shelves is free of a container supported thereon.

13. A retail sales goods display rack for small items, comprising:

(a) a main frame of wire defining a front, a rear, and a pair of downwardly and forwardly inclined sides;

(b) a front shelf located at a lower level;

(c) at least one additional shelf located at a higher level and rearward from said front shelf;

(d) a sloping box display and support portion of wire construction, located laterally adjacent said front and rear shelves;

(e) a vertically adjustable cover support member located rearwardly adjacent one of said shelves;

(f) cover flap means including a front portion, attached to said cover support member and rotatable about a horizontal axis defined by said cover support member, between a horizontal position and an open position in which said front portion is raised above said horizontal position, for selectively covering and providing access to the interior of an upwardly open container supported on said one of said shelves;

(g) cover prop means associated with said support member for supporting said cover flap means with said front portion in a forwardly and downwardly sloping attitude when said one of said shelves is free of a container supported thereon; and (h) a rear auxiliary shelf unit of wire construction having front and rear portions, including attachment means for attaching said front portion supportingly to said rear of said main frame, and including a rear leg supportingly attached to said rear portion of said rear auxiliary shelf unit.

14. A retail sales goods display rack for small items, comprising:

(a) a main frame of wire defining a front, a rear, and a pair of downwardly and forwardly inclined sides;

(b) a front shelf located at a lower level;

(c) at least one additional shelf located at a higher level and rearward from said front shelf;

(d) a sloping box display and support portion of wire construction, located laterally adjacent said front and rear shelves;

(e) a cover support member located rearwardly adjacent one of said shelves and defining a horizontal axis of rotation;

(f) cover flap means including a front portion, attached to said cover support member and rotatable about said horizontal axis of rotation, between a container-covering position and an open position in which said front portion is raised above said container-covertin position, for selectively covering and providing access to the interior of an upwardly open container supported on said one of said shelves; and (g) cover prop means associated with said support member for supporting said cover flap means with said front portion in a forwardly and downwardly sloping attitude and said cover flap means being free to rotate about said axis of rotation downwardly into contact with said prop means when said one of said shelves is free of a container supported thereon.

15. The display rack of claim 14, including one of said cover flap means and a respective cover support member associated with each of said shelves.

16. The display rack of claim 14 wherein said cover support member includes preventer means for preventing said cover flap means from being rotated upwardly away from a container resting on said shelf to a position of stability.

17. The display rack of claim 14 wherein said preventer means includes a horizontally extending member spaced upwardly apart from said horizontal axis.

* * * * *

UNITED STATES PATENT AND TRADEMARK OFFICE

CERTIFICATE OF CORRECTION

PATENT NO. : 4,726,477

DATED : February 23, 1988

INVENTOR(S) : Larry Martin

It is certified that error appears in the above-identified patent and that said Letters Patent is hereby corrected as shown below:

| | | |
|---|---|---|
| Col. 1, | Line 35 | Change "socalled" to --so-called--. |
| Col. 3, | Line 20 | Change "selfclosing" to --self-closing--. |
| Col. 6, | Line 32 | After "said" insert --main--. |
| Col. 8, | Line 10 | After "said" insert --cover--; |
| | Line 43 | After "said" insert --cover--; |
| | Line 39 | Change "tainer-covertin" to --tainer-covering--. |

Signed and Sealed this

Twenty-fifth Day of April, 1989

*Attest:*

DONALD J. QUIGG

*Attesting Officer*

*Commissioner of Patents and Trademarks*